US005426940A

United States Patent [19]

Tomoiu

[11] Patent Number: 5,426,940

[45] Date of Patent: Jun. 27, 1995

[54] FREE PISTON EXTERNAL COMBUSTION ENGINE

[76] Inventor: Constantine Tomoiu, 991 Hancock Ave., Apt. 1, Bridgeport, Conn. 06605

[21] Appl. No.: 201,177

[22] Filed: Feb. 24, 1994

[51] Int. Cl.[6] ..... F02B 71/04

[52] U.S. Cl. ..... 60/595; 60/39.6; 60/39.55

[58] Field of Search ..... 60/39.6, 39.55, 595

[56] References Cited

U.S. PATENT DOCUMENTS

| | | | |
|---|---|---|---|
| 2,299,905 | 10/1942 | Kennon | 60/595 |
| 3,049,866 | 8/1962 | Huber | 60/595 |
| 4,015,424 | 4/1977 | Shinohara . | |
| 4,558,665 | 12/1985 | Sandberg et al. . | |
| 4,589,377 | 5/1986 | Van Dal . | |
| 4,662,177 | 5/1987 | David | 60/595 |
| 4,760,701 | 8/1988 | David | 60/595 |
| 5,237,964 | 8/1993 | Tomoiu . | |

*Primary Examiner*—Richard A. Bertsch
*Assistant Examiner*—Charles G. Freay
*Attorney, Agent, or Firm*—Fattibene and Fattibene; Paul A. Fattibene; Arthur T. Fattibene

[57] ABSTRACT

An internal combustion engine having at least two external variable volume combustion chambers, each with a floating piston. A compressor provides pressurized gas selectively to a first or second end of the combustion chambers. The introduction of the pressurized gas into one end of the combustion chamber forces the floating piston to move to the opposite end. When a predetermined combustion chamber pressure is obtained combustion of previously injected fuel is initiated. At a peak pressure, water is injected in the combustion chamber increasing the pressure further. Valves at either end of the combustion chamber selectively and controllably release the pressure from the combustion chamber depending upon which end the floating piston is located. The pressure released from the combustion chamber is used to drive a plurality of pistons or a turbine, thereby creating useful work such as rotating a shaft. A rotating shaft is used to drive the compressor for supplying the pressurized air to the combustion chamber. Combustion and the release of the combustion gases is alternated from one end of the combustion chamber to the other, and with the use of at least two combustion chambers provides continuous operation. The present invention provides more efficient operation and a more controlled combustion chamber environment resulting in reduced pollution and greater efficiencies.

10 Claims, 5 Drawing Sheets

FREE PISTON EXTERNAL COMBUSTION ENGINE

FIELD OF THE INVENTION

The present invention relates generally to combustion engines, and specifically to an engine having an external variable volume combustion chamber.

BACKGROUND OF THE INVENTION

There have been many advancements in the design and construction of internal combustion engines in an effort to improve their efficiency. One such improvement to an internal combustion engine is disclosed in U.S. Pat. No. 4,015,424 entitled "Combustion Engine With Dual Function Motor Element And Rotary Valve For Cyclical Fuel and Exhaust Meeting" issuing to Shinohara on Apr. 5, 1977. Therein disclosed is an internal combustion engine having a combustion sustaining chamber and a constant pressure chamber. This permits continuous combustion of the fuel mixture being stably maintained. As a result, the amount of poisonous exhaust gas is reduced.

Another improvement in an internal combustion engine is disclosed in U.S. Pat. No. 5,237,964 entitled "Internal Combustion Engine With A New Sequence Of Operation and Combustion" issuing to Tomoiu, the same inventor as the present invention, on Aug. 24, 1993, which is herein incorporated by reference. Therein disclosed is an internal combustion engine having multiple constant volume chambers associated with each piston of an engine. The combustion in each constant volume combustion chamber is controlled to obtain fully developed combustion. Water injectors are used during combustion to increase pressures and lower the temperature of gases within the combustion chamber for controlled release of the combustion gases into a cylinder to perform work.

While there have been many improvements to the operation of the internal combustion engine, most of these improvements have been slight improvements that have not substantially improved the efficiencies and operation of the internal combustion engine. It is therefore necessary to turn away from teachings of the prior art and establish a new and innovative approach to improving the efficiencies of an internal combustion engine.

SUMMARY OF THE INVENTION

The present invention is directed to an external combustion engine having at least two external combustion chambers, each with a free floating piston therein. A compressor supplies pressurized air controllably and selectively to each end of the at least two combustion chambers. When pressurized air is fed into one end of each of the at least two combustion chambers the free floating piston will be forced to the other end of the combustion chamber. When a predetermined pressure is obtained in one of the combustion chambers fuel that has been introduced is ignited. At a predetermined point, water is injected to increase the pressure within the combustion chambers. The combustion chambers are insulated. The pressurized gases due to the combustion are controllably released selectively from either end of the combustion chambers depending upon which end the free floating piston is in. The pressurized combustion gases are directed through a manifold providing energy to drive a rotating shaft. The combustion chambers can provide pressurized combustion gas to a plurality of pistons driving a shaft. The combustion in the variable volume combustion chambers is more easily controlled than conventional internal combustion engines, and the free floating piston in each of the at least two combustion chambers provides continuous two cycle type operation.

Accordingly, it is an object of the present invention to provide an external combustion engine having greater efficiencies.

It is a further object of the present invention to provide an engine that is reliable and requires little maintenance.

It is an advantage of the present invention that it permits use of different types of fuels having different compression ratio requirements.

It is a further advantage of the present invention that various combustion ratios can be used.

It is a feature of the present invention that two variable volume combustion chambers are used for a plurality of cylinders.

It is a further feature of the present invention that cooling system requirements are reduced.

These and other objects, advantages, and features will become readily apparent in view of the following more detailed description.

DETAILED DESCRIPTION OF THE PREFERRED EMBODIMENT

Figure 1:
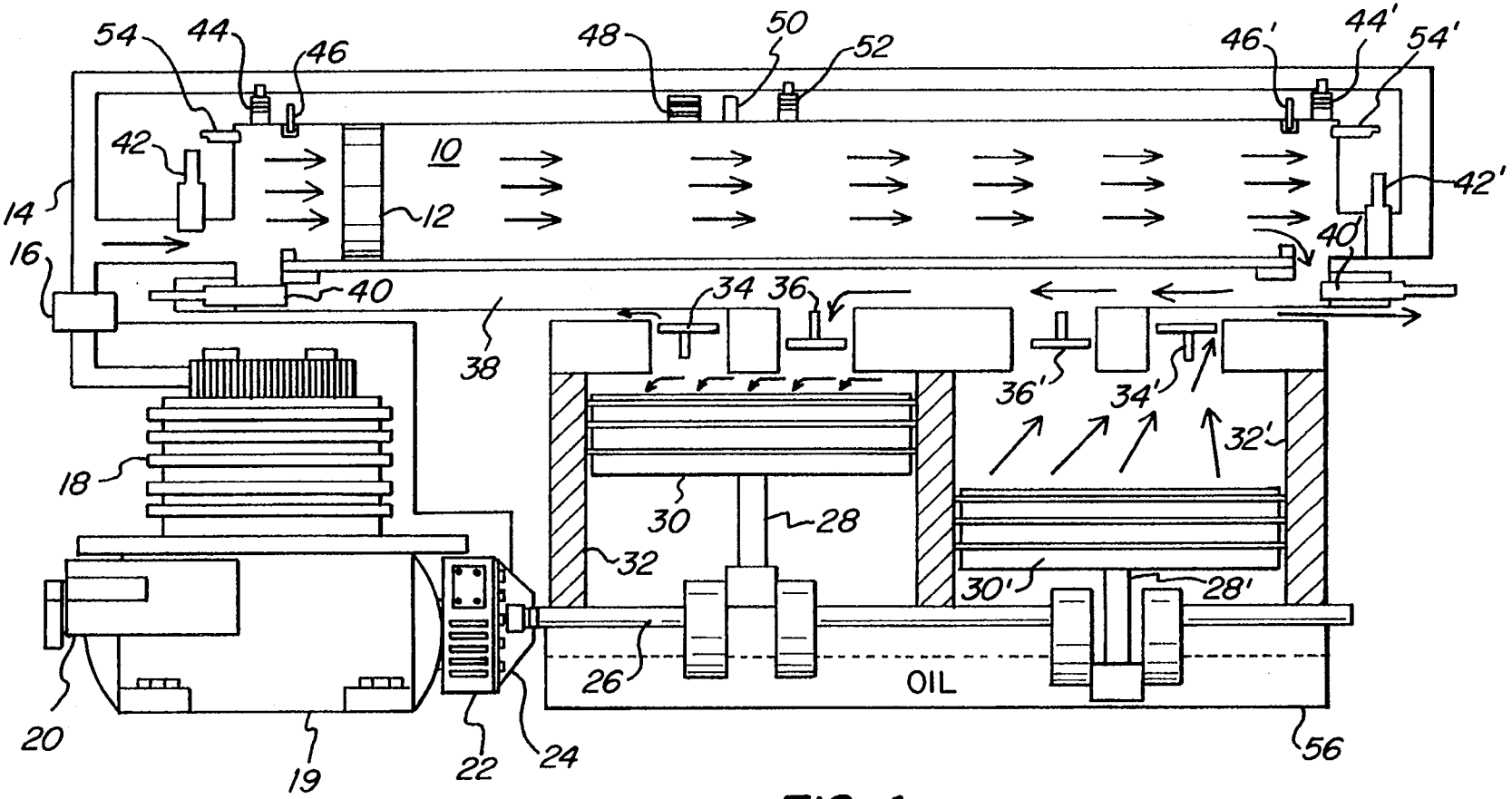
FIG. 1 is a schematic drawing illustrating the present invention.
Figure 4:
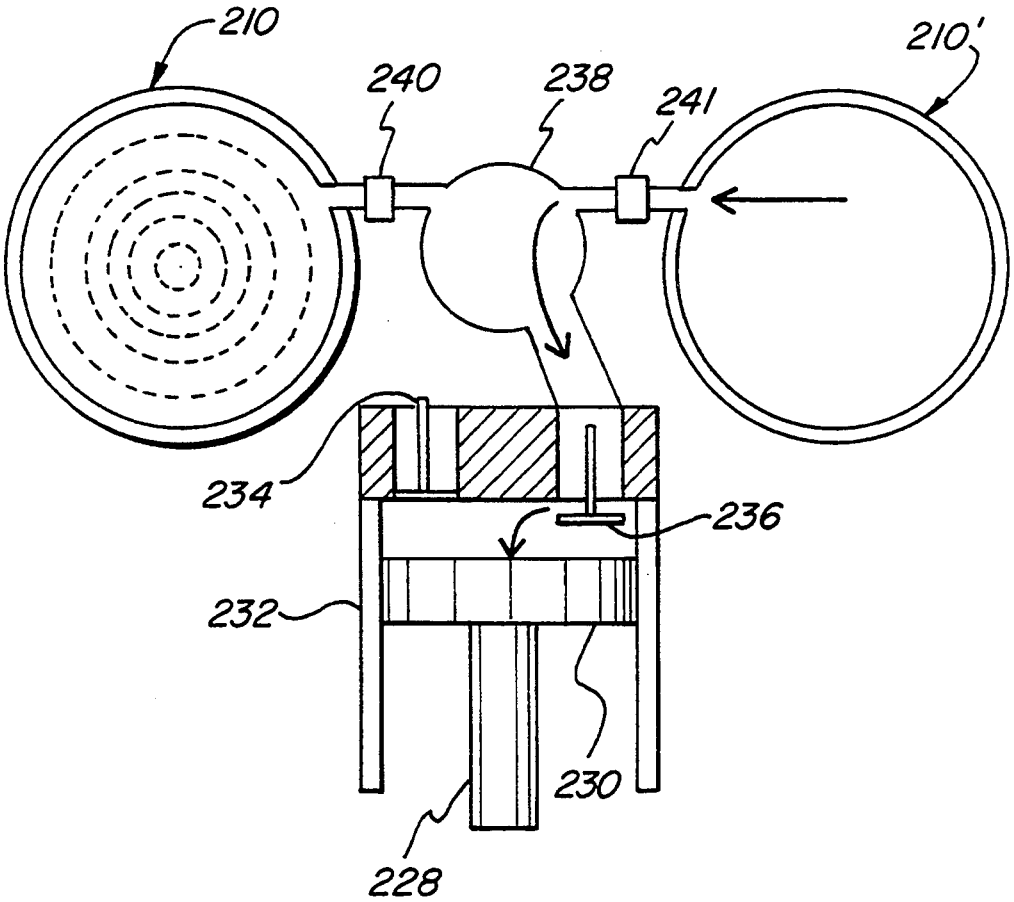
FIG. 4 is a schematic drawing illustrating the present invention with two combustion chambers.

FIG. 1 illustrates the present invention. Combustion chamber cylinder 10 has a variable volume. For ease of illustration only one combustion chamber cylinder 10 is illustrated in FIG. 1. However, to provide continuous power two combustion chamber cylinders 10 will be needed, as illustrated in FIG. 4. A floating piston 12 is free to move from one end thereof to the other. A pressurized air inlet tube 14 communicates with a first and second end of the combustion chamber cylinder 10. The air pressure delivered to the combustion chamber cylinder 10 is controlled by a pressure control cut-off 16. Air pressure is supplied to the pressure air inlet tube 14 by a compressor 18. Associated with the compressor 18 is a compressor housing 19. An electric motor 20 is also associated with the compressor 18. Electric motor 20 is a starter that initially turns the compressor 18 permitting it to provide air pressure to charge the combustion chamber cylinder 10. After initially charging the combustion chamber cylinder 10, the compressor 18 is driven by a gear box 22 associated with a clutch 24 and a crankshaft 26. The crankshaft 26 and the compressor 18 can be made to rotate in opposite directions to aid balance and reduce vibration. The crankshaft 26 is connected to rods 28 and 28', which in turn are connected respectively to pistons 30 and 30'. The pistons 30 and 30' are within cylinders 32 and 32'. The crankshaft 26, rods 28 and 28', and cylinders 32 and 32' are lubricated with oil contained in the crank case 56. Associated with each cylinder 32 and 32' is an exhaust valve 34 and 34', and an inlet valve 36 and 36'. The exhaust valves 34 and 34' communicate with the environment by any conventional exhausting means. The exhaust may be used to drive a turbine associated with the compressor 18, thereby assisting the compressor 18 in providing pressurized air to the combustion chamber cylinder 10. The inlet valves 36 and 36' communicate with an inlet manifold 38. The inlet manifold 38 communicates with the combustion chamber cylinder 10 at either end thereof through a first regulator valve 40 and a second regulator valve 40'. The regulator valves 40 and 40' controllably and selectively release pressurized gas from either end of the combustion chamber cylinder 10, permitting the pressurized gas to enter the inlet manifold 38. Additionally, at either end of the combustion chamber cylinder 10 are positioned a combustion chamber inlet valve 42 and 42'. Within the combustion chamber cylinder 10 at either end thereof is a first and second fuel injector 44 and 44'. Additionally, at either end of the combustion chamber cylinder 10 is a proximity sensor 46 and 46'. The proximity sensors 46 and 46' detect the position of the floating piston 12 when the floating piston 12 is located at either end of the combustion chamber cylinder 10. Within the combustion chamber cylinder 10 is also an ultrasonic generator 48, a pressure sensor 50, and a water injector 52. Combustion within the combustion chamber cylinder 10 is controlled by a spark plug 54 and 54' placed at either end of the combustion chamber cylinder 10.

While the present invention is illustrated with the pistons 30 and 30' and cylinders 32 and 32' forming work producing means for producing work as a result of gas pressure, any work producing means for producing work as a result of gas pressure may also be used, such as a turbine.

Figure 2:
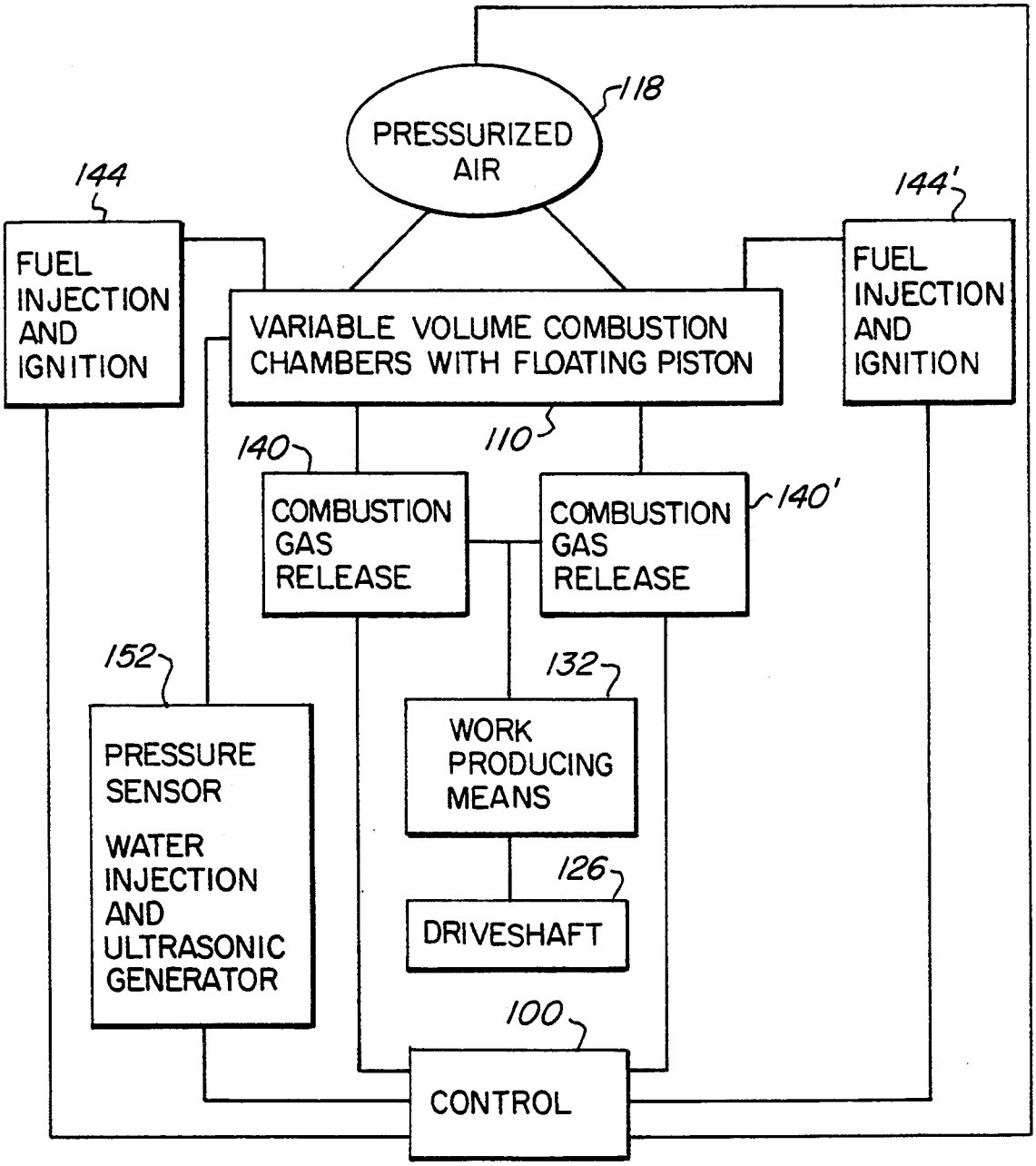
FIG. 2 is a block diagram illustrating the present invention.

FIG. 2 is a block diagram illustrating the operation of the present invention. Pressurized air 118 is fed to a selected end of the variable volume combustion chamber with floating piston 110. Pressurized air 118 pressurizes the combustion chamber 110 until a predetermined pressure is obtained therein, corresponding to an optimized compression ratio for the particular fuel used. Fuel is injected and ignition instituted by fuel injection and ignition 144 and 144' depending on which end the floating piston 12 is located within the variable volume combustion chamber 110. After combustion, the pressure sensor element of the pressure sensor, water injection and ultrasonic generator 152 detects when the pressure has reached a peak pressure signifying fully developed combustion. At the point of fully developed combustion, water is caused to be injected into the combustion chamber. The ultrasonic generator is used to atomize the water. This results in a lowering of the temperature with an increase in pressure. The increase in pressure is a result of the vaporization of the water. Upon a demand for power, the control 100 selectively and controllably releases the pressurized combustion gases within the combustion chamber 110 by activating the combustion gas release 140 or 140'. The combustion gas release 140 or 140' used depends upon which end the floating piston 12 is located in the combustion chamber 110. The combustion gases are released into work producing means 132. The work producing means 132 may be pistons, as illustrated in FIG. 1, or may be a chamber containing a turbine. The work producing means 132 drives a drive shaft 126. The controller 100 controls the injection of the pressurized air 118 into the combustion chamber 110, the fuel injection and ignition 144 and 144' the combustion gas release 140 and 140', and the injection of water as a result of information from the pressure sensor and water injector 152. Once the combustion gases within the combustion chamber 110 fall below a predetermined pressure, the other end of the combustion chamber 110 is charged by the pressurized air 118 to institute another cycle of combustion within the combustion chamber 110. Multiple combustion chambers 110 may be used to deliver pressurized gases to work producing means 132.

Figure 3:
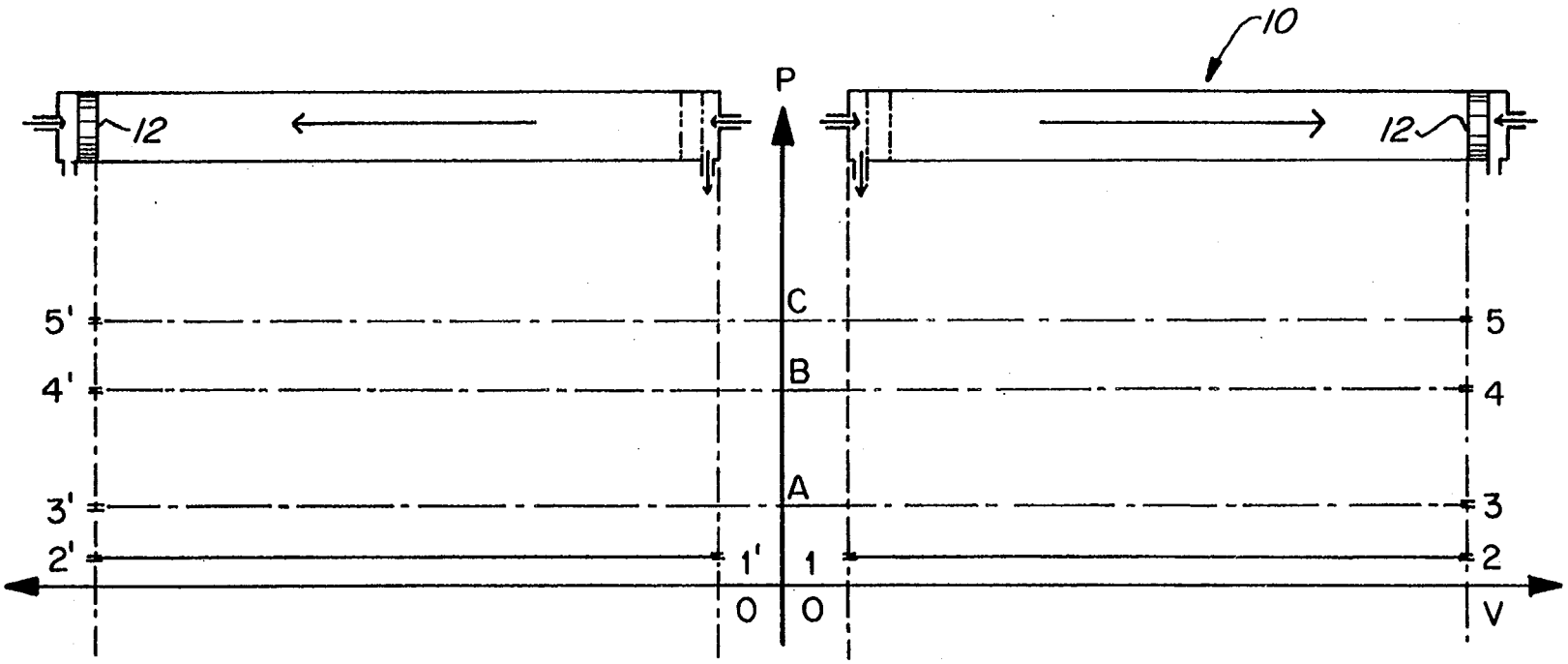
FIG. 3 is a graph illustrating the combustion cycle of the present invention.

FIG. 3 illustrates the cycle of operation of the present invention. This combustion cycle is referred to by the inventor as the Tomoiu cycle. As illustrated in FIG. 3, the volume of the combustion in chamber 10 is represented by the X axis and the pressure is represented by the Y axis. Referring to the right half of the graph in FIG. 3, from point 1 to point 2, during the charging of the combustion chamber cylinder 10 and the movement from left to right of the floating piston 12, the volume of the combustion chamber increases, but the pressure remains substantially constant. When the floating piston 12 reaches its limit, the pressure within the combustion chamber 10 increases as illustrated from point 2 to point 3. The value of the pressure at this point is represent as point A on the pressure or Y axis. At point 3, combustion is started. The pressure then increases to a value at point 4. The pressure at point 4 is illustrated as point B on the pressure or Y axis. Point 4 is the peak pressure due to the combustion which will trigger the injection of water. As a result of the injection of water, the pressure increases to point 5. The pressure at point 5 is illustrated as point C on the pressure or Y axis. After the highest pressure at point 5 is reached, when required by the engine, the pressure is released to drive a shaft. After the pressure drops to a predetermined point where useful work can no longer be accomplished, which may be somewhere between points 2 and 3, the other end of the combustion chamber cylinder 10 is charged with pressurized air causing the piston to move from the left to the right, as illustrated in the left half of the graph in FIG. 3. Another combustion cycle is illustrated on the left half of the graph in FIG. 3. The points 1', 2', 3', 4', and 5' indicate the pressure and volume of the combustion chamber 10 at various points. These points are analogous to those described for points 1, 2, 3, 4, and 5 illustrated on the right half of the graph in FIG. 3.

FIG. 4 illustrates the present invention schematically with the two combustion chamber cylinders 210 and 210' required to provide continuous power. Each of the at least two combustion chamber cylinders 210 and 210' are connected to an inlet manifold 238 through a first and second regulator valve 240 and 241 respectively. Each end of the at least two combustion chamber cylinders 210 and 210' have a first and second regulator valve 240 and 241 respectively. The inlet manifold 238 is connected to a cylinder 232 and piston 230 by an inlet valve 236. Piston 230 is connected to a rod 228. The cylinder 232 also has an exhaust valve 234.

Figure 5:
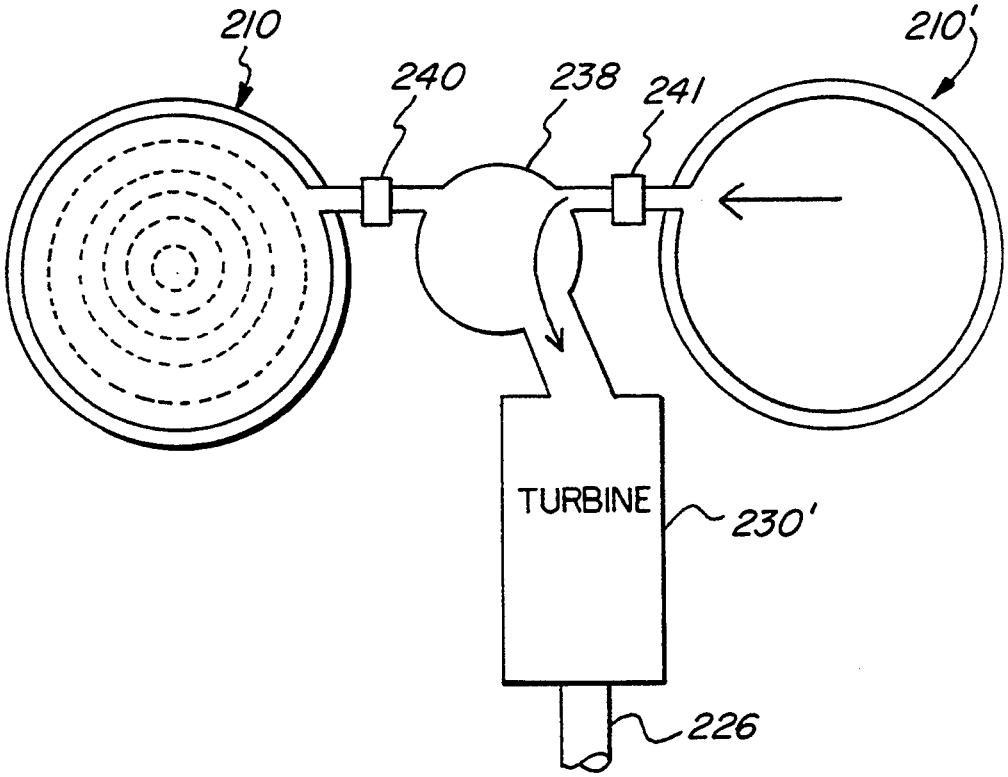
FIG. 5 is a schematic drawing illustrating the present invention with a turbine.

In operation, one combustion chamber cylinders 210 or 210' is pressurized and combustion initiated. The pressurized gases are then let into the inlet manifold 238 by either regulator valve 240 or 241. The pressurized gases are used to drive piston 230 for producing work. Before the pressurized gases in one of the combustion chamber cylinders 210 or 210' pressure falls below a useful level, the other one of the combustion chamber cylinders 210 or 210' is pressurized and combustion initiated. Therefore, by alternating between the two combustion chamber cylinders 210 and 210' a steady supply of power is provided for continuous operation of the piston 230, or other similar work producing means such as a turbine. FIG. 5 illustrates another embodiment of the present invention schematically. FIG. 5 is identical to the embodiment as illustrated in FIG. 4, except that the work producing means is a turbine 230' rather than a cylinder and piston as illustrated in FIG. 4. The pressurized gas from the at least two combustion chamber cylinder 210 and 210' is directed through the turbine 23' to drive a shaft 226.

The present invention provides a new sequence of operation and combustion that makes possible optimizing the combustion depending upon the fuel used. This helps reduce pollutants and increase efficiency. The use, in the present invention, of a free floating piston providing a variable volume combustion chamber and of at least two combustion chambers permits pressurized combustion gases to be continuously provided for the production of useful work.

Although the preferred embodiment has been illustrated and described, it will be obvious to those skilled in the art that various modifications may be made without departing from the spirit and scope of this invention.

What is claimed is:

1. An external combustion engine comprising:

at least two combustion chamber cylinders each having a first and second end;

a floating piston in each of said at least two combustion chamber cylinders;

pressurized gas means, associated with each of said at least two combustion chamber cylinders, for providing pressurized gas selectively to either the first or second ends of each of said at least two combustion chamber cylinders;

injection means, associated with each of said at least two combustion chamber cylinders, for injecting fuel into said at least two combustion chamber cylinders;

ignition means, associated with each of said at least two combustion chamber cylinders, for igniting fuel;

release means, associated with each of said at least two combustion chamber cylinders and the first and second ends, for selectively and controllably releasing combustion gas from each of said at least two combustion chamber cylinders; and work producing means, associated with said release means, for receiving pressurized combustion gas from each of said at least two combustion chamber cylinders and performing work.

2. An external combustion engine as in claim 1 wherein: said work producing means comprises a plurality of pistons.

3. An external combustion engine as in claim 1 wherein: said work producing means comprises a turbine.

4. An external combustion engine as in claim 1 wherein: said pressurized gas means comprises a compressor.

5. An external combustion engine as in claim 4 wherein: said compressor is driven by said work producing means.

6. An external combustion engine as in claim 1 further comprising:

combustion chamber sensor means, associated with each of said at least two combustion chamber cylinders, for detecting fully developed combustion;

a water injector associated with each of said at least two combustion chamber cylinders; and control means, associated with said combustion chamber sensor means and said water injector, for controlling the injection of water.

7. An external combustion engine as in claim 6 further comprising:

an ultrasonic generator associated with each of said at least two combustion chamber cylinders.

8. An external combustion engine comprising:

at least two combustion chamber cylinders each having a first and second end;

a floating piston in each of said at least two combustion chamber cylinders;

a compressor;

a tube connected to said compressor and the first and second ends of each of said at least two combustion chamber cylinders;

a first valve associated with the first end of each of said at least two combustion chamber cylinders and said compressor;

a second valve associated with the second end of each of said at least two combustion chamber cylinders and said compressor;

a fuel injector associated with each of said at least two combustion chamber cylinders;

a plurality of cylinders associated with said at least two combustion chamber cylinders;

a plurality of pistons, one of said plurality of pistons associated with one of said plurality of cylinders;

an inlet valve associated with each of said plurality of cylinders;

an exhaust valve associated with each of said plurality of cylinders;

a manifold communicating with said at least two combustion chamber cylinders and said plurality of cylinders;

a first regulator valve associated with the first end of each of said at least two combustion chamber cylinders and said manifold;

a second regulator valve associated with the second end of each of said at least two combustion chamber cylinders and said manifold;

a rotating shaft connected to said plurality of pistons, said rotating shaft connected to said compressor; and control means, associated with said first and second valves of each of said at least two combustion chamber cylinders, said compressor, said fuel injector, said inlet valve, said exhaust valve, and said first and second regulator valves of each of said at least two combustion chamber cylinders, for controlling combustion within said combustion chamber cylinder and release of combustion gases into said plurality of cylinders.

9. An external combustion engine as in claim 8 further comprising:

combustion chamber sensor means, associated with each of said at least two combustion chamber cylinders, for detecting fully developed combustion; and a water injector associated with each of said at least two combustion chamber cylinders.

10. An external combustion engine as in claim 9 further comprising:

an ultrasonic generator associated with each of said at least two combustion chamber cylinders.

* * * * *